United States Patent [19]

Hilton et al.

[11] 4,097,762

[45] Jun. 27, 1978

[54] XENON ARC DISCHARGE LAMP HAVING A PARTICULAR ELECTRODE COMPOSITION AND WHEREIN THE ARC DISCHARGE IS OBTAINED WITHOUT HEATING THE ELECTRODE

[75] Inventors: Joseph James Hilton, Bethlehem; James Joseph Malloy, Jr., Easton, both of Pa.

[73] Assignee: International Telephone & Telegraph Corporation, Nutley, N.J.

[21] Appl. No.: 797,660

[22] Filed: May 17, 1977

Related U.S. Application Data

[63] Continuation of Ser. No. 604,676, Aug. 14, 1975, abandoned.

[51] Int. Cl.[2] ..... H01J 17/04; H01J 61/06

[52] U.S. Cl. ..... 313/218; 313/224; 313/346 R

[58] Field of Search ..... 313/218, 224, 346 R, 313/346 DC, 336

[56] References Cited

U.S. PATENT DOCUMENTS

| | | | |
|---|---|---|---|
| 2,700,000 | 1/1955 | Levi et al. | 313/346 R X |
| 2,700,118 | 1/1955 | Hughes et al. | 313/346 R |
| 2,896,107 | 7/1959 | Anderson | 313/224 X |
| 3,244,929 | 4/1966 | Kuhl | 313/346 R X |
| 3,849,690 | 11/1974 | Cosco et al. | 313/218 X |
| 3,911,309 | 10/1975 | Kummel et al. | 313/218 X |
| 3,936,767 | 2/1976 | Besson et al. | 313/218 X |
| 3,988,629 | 10/1976 | White et al. | 313/218 X |
| 3,989,973 | 11/1976 | Lange et al. | 313/218 X |

*Primary Examiner*—Gerard R. Strecker

*Attorney, Agent, or Firm*—John T. O'Halloran; Jeffrey P. Morris

[57] ABSTRACT

An electrode for an arc discharge lamp includes a porous sintered body of tungsten impregnated with a mixture of alkaline earth oxides and a metal oxide. The alkaline earth materials may be oxides of barium and calcium, and the metal oxide may be aluminum oxide. The body is brazed or welded to the end of a high melting point refractory metal support of tungsten or molybdenum. Two identical electrodes are used as the cathodes of a long arc alternating current type xenon lamp and one such electrode provides the cathode of a short arc direct current xenon lamp. The structure and materials provide greater efficiency and extended life under continuous operating conditions.

5 Claims, 4 Drawing Figures

18
20
16

22

14
10
12

26
22
24

XENON ARC DISCHARGE LAMP HAVING A PARTICULAR ELECTRODE COMPOSITION AND WHEREIN THE ARC DISCHARGE IS OBTAINED WITHOUT HEATING THE ELECTRODE

This is a continuation, of application Ser. No. 604,676, filed Aug. 14, 1975, now abandoned.

BACKGROUND OF THE INVENTION

1. Field of the Invention

The present invention concerns a novel electrode for an arc discharge lamp and particularly to an electrode material which provides an efficient long life cathode for continuous lamp operation.

2. Description of the Prior Art

Tungsten matrix materials have been employed as thermionic dispenser cathodes in electrode tubes as described in U.S. Pat. No. 2,700,000, issued Jan. 18, 1955. These have included a porous sintered metal body of a refractory material such as tungsten or molybdenum impregnated with a fused mixture of an alkaline earth oxide and a metal oxide. Such thermionic cathodes operate at lower temperatures than arc discharge lamps. Use of a cathode pellet of a powdered refractory metal such as tantalum or tungsten and an alkaline earth compound such as barium aluminate or carbonate, has also been described in U.S. Pat. No. 3,849,690, issued Nov. 19, 1974. The pellet was pressure formed or heat shrunk onto a metal base support. This material and structure, however, were used in a triggered or pulsed flash tube wherein requirements for strength and low cathode evaporation are not as severe as in a continuously operated lamp.

SUMMARY OF THE INVENTION

It is therefore the primary object of the present invention to provide an improved long life efficient cathode for a continuous type arc discharge lamp.

This is achieved by a novel electrode which includes a porous sintered body of tungsten impregnated with alkaline earth oxides such as barium and calcium oxides and a metal oxide such as aluminum oxide. The body is brazed or welded to the end of a refractory metal support of tungsten or molybdenum to withstand heavy currents under continuous operating conditions and the particular metal oxide acts to reduce evaporation of electrode materials. Two such devices provide the electrodes of a long arc a.c. operated xenon lamp, and one electrode is used as a cathode in a d.c. type short arc lamp.

DESCRIPTION OF THE PREFERRED EMBODIMENTS

Figures 1, 2, 3, 4:
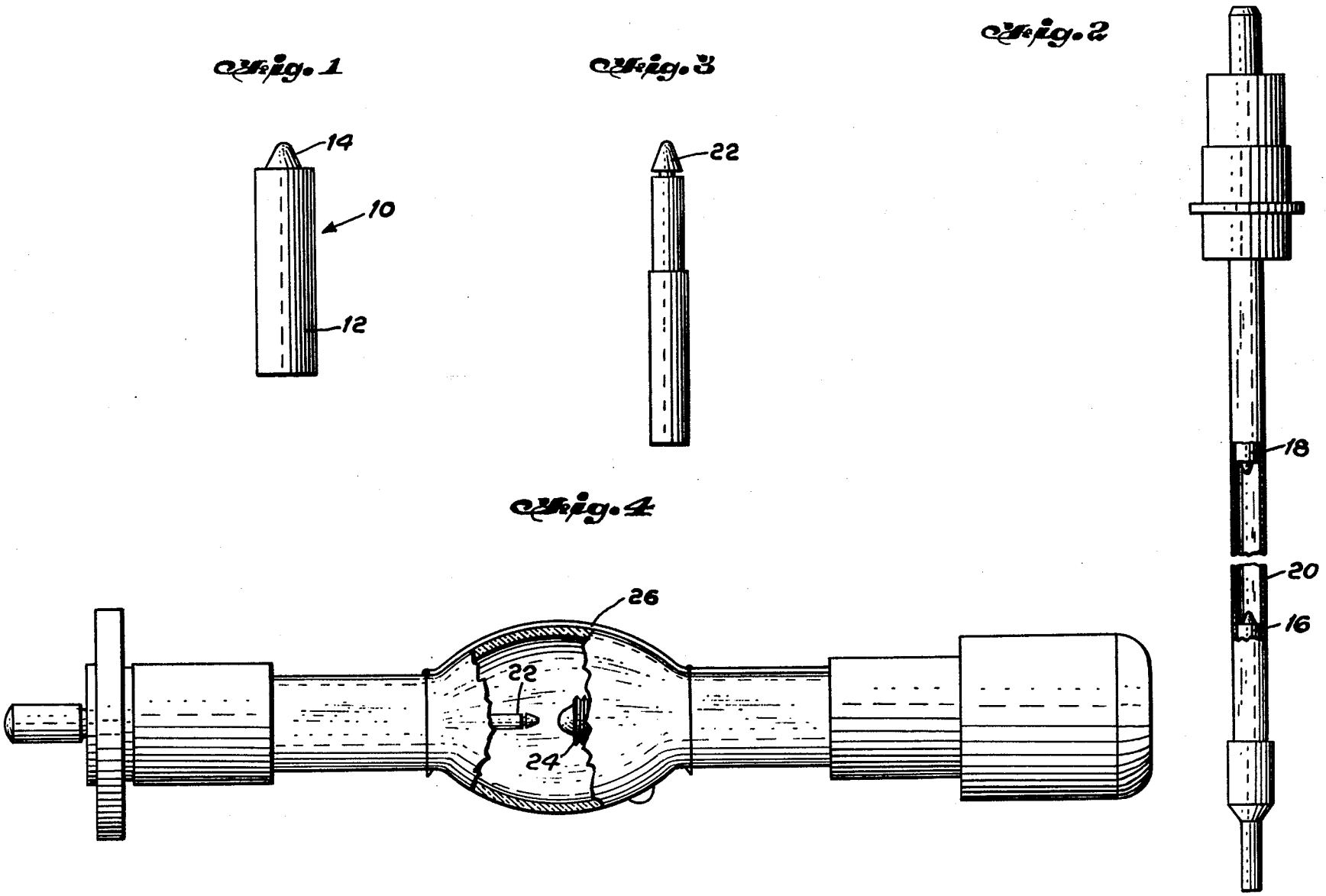
FIG. 1 shows an electrode made in accordance with the present invention for use in a long arc lamp.
FIG. 2 is a view of a long arc lamp showing two like electrodes.
FIG. 3 shows a cathode as used in a short arc lamp.
FIG. 4 is a view of a short arc lamp showing one cathode and one anode.

As shown in FIG. 1, an electrode 10 of an arc discharge lamp such as a xenon lamp, includes a base or support 12, of a high melting point refractory material such as tungsten or molybdenum. The end of the electrode includes an electron emissive cap 14, or cathode, which is formed of a porous sintered body of tungsten impregnated with a mixture of alkaline earth materials and a metal oxide. As a specific example the body may be 84% by weight of tungsten. The alkaline earth oxides are preferably of barium and calcium, and the metal oxide is of aluminum, which for example may be in the ratio of 4 parts BaO to 1 part CaO and 1 part $Al_2O_3$. The use of tungsten permits operation at lower temperatures and voltages to reduce evaporation of the cathode material under continuous operating conditions and the particular alkaline earth materials provide a low work function characteristic.

In any lamp under constant gap voltage conditions, the electrons emitted from a given material is a function of material temperature. The number of electrons available at a given temperature is related to the electron work function of the material. As the electron work function of a material decreases, the number of electrons available at the surface increases. Therefore under conditions requiring a specific amount of electron current, the cathode having a low work function can operate at a temperature lower than a cathode having a higher work function.

A xenon lamp is an optical device. The application as an optical device demands a low rate of evaporation of any material on the quartz envelope in order to have maximum light output. Conventional cathodes requiring high operating temperature evaporate the base material at a faster rate than tungsten matrix cathodes of lower work function operating at a lower temperature.

Certain applications require a xenon lamp to ignite and operate over a large voltage input range. Erosion of the cathode tip causes the cathode-anode gap distance to increase. The effect of this increased distance is to cause the minimum voltage required for starting the lamp to increase with life. This is not a desirable characteristic of any lamp. A low work function tungsten cathode operating at a lower temperature will not erode as fast as a tungsten cathode of high work function operating at high temperature. Therefore the starting voltage remains more constant with life.

The present combination of material provides a tungsten matrix cathode of lower electron work function which permits operation at lower temperatures. This results in lower rates of evaporation and longer lamp life. The lower work function material permits generation of electrons with less starting energy and lower starting voltages and reduces erosion of the cathode. More uniform emission from the cathode also reduces radio frequency interference. The end cap 14 is also brazed to the base 12 to provide an improved mechanical support under the severe continuous operating conditions.

As shown in FIG. 2, two such electrodes are disposed at opposite ends of a typical long arc xenon lamp for alternating current operation. In this case, each electrode 16, 18 alternately acts as the cathode during one-half cycle of operation while the opposite electrode acts as the anode. A suitable voltage, typically about 120 volts a.c., is applied across the external conductors at the ends of the lamp to provide the continuous arc discharge. Transparent envelope 20 is preferably of quartz and is filled with xenon gas to a desired pressure.

FIG. 3 shows a variation of the electrode which provides a cathode 22 for use in a typical short arc direct current operated xenon lamp, as in FIG. 4. The anode 24 is preferably formed of pure tungsten for good heat conductivity and a direct potential of about 25 to 30 volts is applied across the opposite ends of the lamp. In order to initially start the lamp, a short r.f. pulse of 20 Kv, from an external source, is applied across the electrodes. An external wire 26 also couples some of this energy through the envelope to the gas to aid in starting. A similar r.f. starter pulse is used in the long arc discharge tube without an external start wire.

The present invention thus provides an improved long life electrode for an arc discharge lamp. While only a limited number of embodiments have been illustrated and described, it is apparent that many other variations may be made in the particular design and configuration without departing from the scope of the invention as set forth in the appended claims.

What is claimed is:

1. In a xenon arc discharge lamp comprising an enclosed pressurized sealed optical envelope having a light transparent window, a pair of electrodes at opposite ends of said lamp, and means for applying a potential across said electrodes to provide an arc discharge therebetween, the improvement in which at least one of said electrodes comprises a porous sintered body of a refractory metal selected from the group consisting of tungsten and molybdenum, said body being impregnated with a fused mixture of alkaline earth oxides and a metal oxide, said arc discharge being obtained solely through field emission by application of said potential without heating said electrode.

2. The electrode of claim 1 wherein said body is of tungstem impregnated with barium calcuim aluminate and wherein said barium calcium aluminate is of the ratio of 4 parts BaO, 1 part CaO and 1 part $A1_2O_3$.

3. The device of claim 1 wherein both electrodes of said pair are of the same material.

4. The device of claim 1 wherein said electrode includes a support of refractory metal selected from the group consisting of tungsten and molybdenum, said body being brazed to the end of said support.

5. The device of claim 4 wherein said body is of tungsten impregnated with barium calcium aluminate.

* * * * *